US006581429B1

(12) United States Patent
Takakura et al.

(10) Patent No.: US 6,581,429 B1
(45) Date of Patent: Jun. 24, 2003

(54) STRIP WIPER DEVICE, STRIP WIPING METHOD, ROLLING MILL AND ROLLING METHOD

(75) Inventors: Yoshio Takakura, Hitachi (JP); Toshiyuki Kajiwara, Katsushika-ku (JP); Kenichi Yasuda, Hitachinaka (JP); Yukio Hirama, Mito (JP); Minoru Igari, Tokai-mura (JP); Takashi Norikura, Hitachi (JP); Hidekazu Tabata, Takahagi (JP); Norihito Satou, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/787,534

(22) PCT Filed: Mar. 31, 1999

(86) PCT No.: PCT/JP99/01677

§ 371 (c)(1),
(2), (4) Date: Jun. 20, 2001

(87) PCT Pub. No.: WO00/59652

PCT Pub. Date: Oct. 12, 2000

(51) Int. Cl.[7] ..... B21B 27/06; B08B 3/00; A47L 1/02

(52) U.S. Cl. ..... 72/236; 72/39; 72/241.6; 15/102; 134/15; 134/122 R

(58) Field of Search ..... 72/39, 201, 206, 72/236, 241.2, 241.6, 245; 384/116; 15/102, 103.5; 134/15, 122 R

(56) References Cited

U.S. PATENT DOCUMENTS

| | | | | |
|---|---|---|---|---|
| 4,060,288 A | * 11/1977 | Arsenius et al. | ..... | 308/73 |
| 4,474,483 A | * 10/1984 | Suzuki et al. | ..... | 384/114 |
| 4,530,227 A | * 7/1985 | Schlatter et al. | ..... | 72/245 |
| 4,551,878 A | * 11/1985 | Turley et al. | ..... | 15/102 |
| 5,079,939 A | * 1/1992 | Shook | ..... | 72/39 |
| 5,281,032 A | * 1/1994 | Slocum | ..... | 384/118 |
| 5,470,438 A | * 11/1995 | Sollinger et al. | ..... | 384/116 |
| 6,129,453 A | * 10/2000 | Holopainen et al. | ..... | 384/116 |

FOREIGN PATENT DOCUMENTS

| | | | |
|---|---|---|---|
| JP | 59-49093 | 11/1984 | |
| JP | 61-182609 | 11/1986 | |
| JP | 1-148413 | * 6/1989 | ..... 384/100 |
| JP | 2-60403 | 12/1990 | |
| JP | 6-39423 | * 2/1994 | ..... 72/40 |
| JP | 2523725 | 5/1996 | |

* cited by examiner

*Primary Examiner*—Ed Tolan
(74) *Attorney, Agent, or Firm*—Crowell & Moring LLP

(57) ABSTRACT

To improve the productivity of the cold rolling facility by providing the cold rolling facility with a strip wiper free of dust and foreign matters suitable for high-speed rolling. The wiping ability was greatly improved by floating and supporting the wiper roll by the static pressure bearing of air of two-pocket type, and by variably adjusting the load range of the floating force in response to the plate width. At high-speed rolling exceeding 700 m/min which was incapable with the conventional roll wiper or tube wiper, the productivity of the cold rolling facility and the surface quality of the strip were greatly improved by applying to the cold rolling facility the wiping device whose wiping ability is equal to or better than the tube wiper at low speeds, and its effect is very large.

38 Claims, 9 Drawing Sheets

23c
7
9
23
23a
23b
1
8
Ps
Φd
P
9'

STRIP WIPER DEVICE, STRIP WIPING METHOD, ROLLING MILL AND ROLLING METHOD

This application is a 35 USC 371 of PCT/JP99/01677, filed Mar. 31, 1999.

BACKGROUND OF THE INVENTION

The present invention relates to a strip wiper, strip wiping method, rolling facility, and rolling method.

In rolling operation, a rolling lubricant is supplied to the entrance of a rolling mill so as to reduce friction between the strip (rolled material) and the rolling work roll and to cool the work roll. Particularly, in cold rolling operation with a 20-high Sendzimir rolling mill having work rolls of extremely small diameter or a 6-high rolling mill having work rolls of small diameter, a lubricant is supplied also to the exit of the rolling mill so as to increase the cooling capacity of the work rolls.

Moreover, in the rolling of shadow mask materials by rolling mills, dull rolling with dull rolls is carried out in the final pass of rolling process so as to roughen the surface of the rolled material. In dull rolling like this, the surface of the rolled material is soiled with dull powder (powder fall off from the dull roll) and hence a rolling lubricant is supplied to the exit of the rolling mill to wash out the dull powder.

The rolling mills supplied with a lubricant as mentioned above yield rolled strips carrying a large amount of lubricant on their surface. When a strip is wound into a coil, with its surface carrying a large amount of rolling lubricant supplied at the entrance of the roll mill, particularly at the exit of the roll mill, the wound coil becomes a "telescope", with each layer slipping sideward due to rolling lubricant present between layers. The telescoped coil leads to meandering and irregular forms, inhibiting stable rolling operation.

Also, in the case where there exists bridle rolls (to add tension to the strip) at the exit of the rolling mill, the rolling lubricant extremely decreases the coefficient of friction between the bridle rolls and the strip, disabling stable operation (as in the case mentioned above) due to insufficient tension.

It is the strip wiper that removes the rolling lubricant from the strip surface. The strip wiper is available in different types, such as tube wiper, roll wiper, and air-jet wiper.

A tube wiper is highly capable of wiping but its tube is short in life when foreign matter (such as dust) enters it. This is significant particularly in the case of high-speed operation. A tube wiper for dull rolling has the disadvantage of impairing the surface quality of the rolled material due to tube clogging with dull powder.

As a substitute for this, a roll wiper has been proposed in Japanese Patent Publication No. 60403/1990. It is designed to improve the wiping capacity by pressing the staggered split back-up rolls individually with springs, thereby distributing the pressing force toward the trip uniformly in the widthwise direction. The disadvantage of this system is that the wiper roll is bent by the supporting force of the back-up roll extending outside the strip width, resulting in a poor shape with an elongated end, if the pressing force is strong. This wiper roll, therefore, is poor in wiping ability due to limited pressing force. At the time of high-speed operation, the wiper roll, which is not driven, does not rotate due to hydroplaning which results from the fact that the rolling lubricant on the roll surface forms an oil film between the roll and the strip. The result is incomplete wiping, or the non-rotating roll scratches the strip surface. In addition, this roll wiper is liable to stop because of many back-up rolls and its comparatively high bearing seal resistance.

In order to address this problem, there has been proposed a roll wiper (having a wiper roll supported by an air bearing) in Japanese Patent No. 2523725. It has a small diameter for good wiping performance because it is supported uniformly on its surface by an air bearing. In addition, the roll wiper of air bearing type has its roll floated and supported by high-pressure air, so that it has a very low rolling friction. It remains turning at speeds as high as 700 m/min, and hence it is suitable for high-speed rolling.

Unfortunately, the roll wiper of air beating type has never been put to practical use because of its low wiping performance which results from the fact that the air bearing is lower in its load capacity than the static bearing of hydraulic type. (It is to be noted that the air pressure for the air bearing is usually lower than 5 kgf/cm$^2$, whereas the hydraulic pressure is as high as 100 kgf/cm$^2$.) Another problem is that the air bearing of one-pocket type is low in rigidity in the horizontal direction and hence the roll comes into contact with the bearing when it receives even a slight horizontal force. This prevents normal operation. The roll rotating at high speeds affects the air flow in the beating (making the air flow asymmetric in the bearing), reducing further the horizontal rigidity to allow the roll to come into contact with the bearing.

For the reasons mentioned above, it is desirable to propose a high-speed roll wiper capable of better wiping than the conventional tube wiper, by increasing the load capacity of the air bearing and preventing the excessive pressure at edges.

It is an object of the present invention to provide a strip wiper device highly capable of removing liquid from the strip surface, a method for strip wiping, a rolling facility, and a rolling method.

SUMMARY OF THE INVENTION

The present invention is directed to a strip wiper device to remove liquid from the strip surface which comprises a wiper roll to remove liquid from the strip surface and a fluid bearing to support the wiper roll, with the fluid bearing having at least two fluid passages in the circumferential direction of the roll.

The present invention is directed to a strip wiper device to remove liquid from the strip surface which comprises a first strip wiper and a second strip wiper which are arranged sequentially in the direction of strip advance, the second strip wiper being made up of a wiper roll and a fluid bearing to support the wiper roll, with the fluid bearing having at least two fluid passages in the circumferential direction of the roll.

The present invention is directed also to a strip wiper device to remove liquid from the strip surface which comprises a first strip wiper and a second strip wiper which are arranged sequentially in the direction of strip advance, the second strip wiper being made up of a wiper roll and a fluid bearing to support the wiper roll, with the fluid bearing having at least two fluid passages in the circumferential direction of the roll.

The present invention is directed also to a strip wiper device to remove liquid from the strip surface in cold rolling which comprises a first strip wiper for rough wiping and a second strip wiper for finishing which are arranged sequentially in the direction of strip advance, the second strip wiper being made up of a wiper roll and a fluid bearing to support the wiper roll by pneumatic pressure, with the fluid bearing having at least two fluid passages (for pneumatic pressure to the wiper roll) in the circumferential direction of the roll, such that the wiper roll is supported by pneumatic pressure in two directions from the two fluid passages.

The present invention is directed also to a strip wiper device to remove liquid from the strip surface which comprises a first strip wiper and a second strip wiper which are arranged sequentially in the direction of strip advance, the first and second strip wipers each being made up of a wiper roll and a fluid bearing to support the wiper roll, with the fluid bearing having at least two fluid passages in the circumferential direction of the roll.

The present invention is directed also to a strip wiper device to remove liquid from the strip surface which comprises a first strip wiper and a second strip wiper which are arranged sequentially in the direction of strip advance, the second strip wiper being made up of a wiper roll and a fluid bearing to support the wiper roll.

The present invention is directed also to a method of strip wiping to remove liquid from the strip surface which is characterized in that wiper rolls supported by fluid bearings are arranged up and down, with the fluid bearing having at least two fluid passages in the circumferential direction of the roll, the fluid passage is supplied with a fluid so that the wiper roll is born by the fluid and is pressed against the strip.

The present invention is directed also to a method of strip wiping to remove liquid from the strip surface which is characterized in that a wiper roll for rough wiping removes liquid from the strip surface and wiper rolls supported by fluid bearings are arranged up and down at the downstream side, with the fluid bearing having at least two fluid passages in the circumferential direction of the roll, the fluid passage is supplied with a fluid so that the wiper roll is born by the fluid and is pressed against the strip.

The present invention is directed also to a rolling facility which comprises a rolling mill and a strip wiper device to remove liquid from the strip surface at the exit of the rolling mill, said strip wiper device being made up of a wiper roll to remove liquid form the strip surface and a fluid bearing to support the wiper roll, with the fluid bearing having at least two fluid passages in the circumferential direction of the roll.

The present invention is directed also to a rolling method to be applied to a rolling facility made up of a rolling mill and a strip wiper device to remove liquid from the strip surface at the exit of the rolling mill, said method being characterized in that wiper rolls supported by fluid bearings are arranged over and under the strip, the fluid bearing has at least two fluid passages in the circumferential direction of the roll and the passages are supplied with a fluid so that the wiper roll is born by the fluid, and the wiper roll is pressed against the strip so that liquid is removed from the strip surface while rolling is carried out.

The present invention is directed also to a rolling method to be applied to a rolling facility made up of a rolling mill and a strip wiper device to remove liquid from the strip surface at the exit of the rolling mill, said method being characterized in that a wiper roll for rough wiping removes most liquid from the strip surface, wiper rolls supported by fluid bearings are arranged over and under the strip, the fluid bearing has at least two fluid passages in the circumferential direction of the roll and the passages are supplied with a fluid so that the wiper roll is supported in two directions by pneumatic pressure, and the wiper roll is pressed against the strip so that liquid remaining unremoved by the wiper for rough wiping is removed from the strip surface while rolling is carried out.

The present invention is directed also to a strip wiper device which comprises a wiper roll to remove liquid from the strip surface and a fluid bearing to support the wiper roll, said fluid bearing having at least two fluid jet nozzles toward the wiper roll in the circumferential direction of the roll.

The present invention is directed also to a strip wiper device which comprises a wiper roll to remove liquid from the strip surface and a fluid bearing to support the wiper roll, said fluid bearing having at least one each fluid jet nozzle at the entrance and exit from the wiper roll axis center.

The present invention is directed also to a strip wiper device which comprises a wiper roll to remove liquid from the strip surface and a fluid bearing to support the wiper roll, said fluid bearing having at least two fluid jet nozzles toward the wiper roll in the circumferential direction of the roll, said jet nozzles being arranged such that their jet direction is toward the wiper axis center.

DETAILED DESCRIPTION OF THE PREFERRED EMBODIMENTS

The mode for carrying out the invention will be described in the following.

In order to maximize the ability to wipe off rolling lubricant from the rolled material (strip), it is necessary to optimize the parameter which determines the wiping ability.

Figure 6:
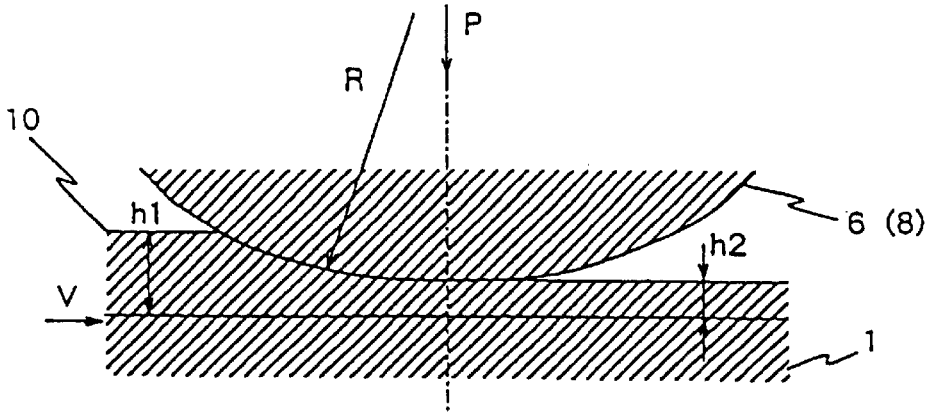
FIG. 6 is a diagram showing the state of wiping by the roll wiper.

FIG. 6 is a partly enlarged sectional view in the case where the rolling lubricant 10 is removed from the surface of the strip 1 by using a roll. The thickness of the residual oil film remaining after wiping by the roll wiper shown in FIG. 6 is represented by the equation (1).

$$h2=K\cdot(R\cdot v\cdot V)/P \quad (1)$$

where thickness of residual oil film: h2 ($\mu$m), proportionality constant : K (=$6.1\times10^{-6}$), wiper roll radius: R (mm), lubricant viscosity: ν (cSt), velocity: V (cm/min), and wiper roll pressing force: P (kgf/mm).

As understood from this equation (1), in order to increase the wiping ability, it follows that the pressing force P should be increased by using a roll having a small radius R. It is also understood that reducing the lubricant viscosity ν is effective.

Figure 4:
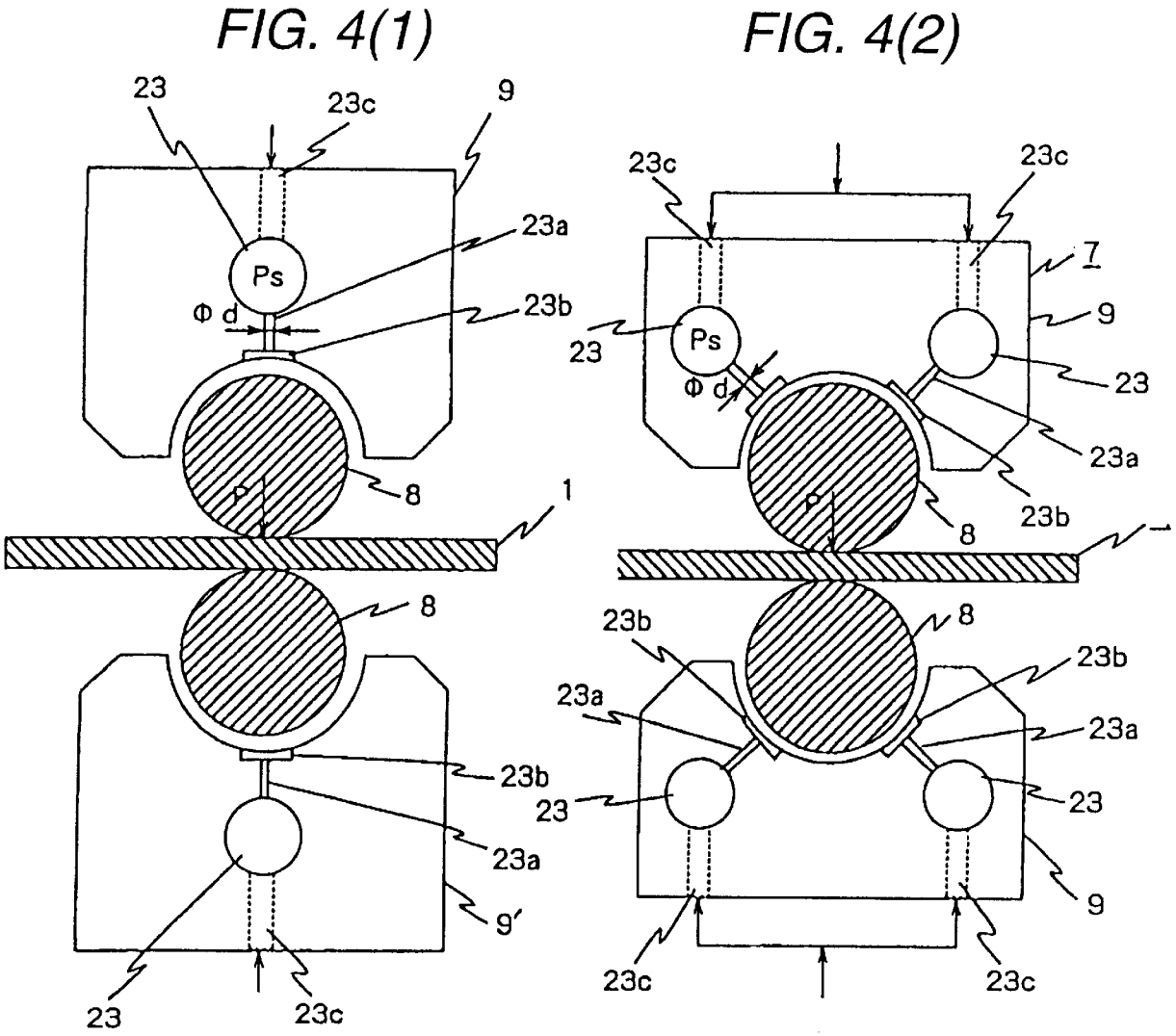
FIG. 4 is a diagram showing the structure of the air bearing.

On the other hand, in one embedment of the present invention, the pressing force is maintained by the air bearing as shown in FIG. 4. This pressing force P is represented by the following equation (2).

$$P=C\cdot R\cdot ps \quad (2)$$

Where, the proportionally constant C=0.25 in the case of one-pocket type in FIG. 4 (1), and the proportionally constant C=0.38 in the case of two-pocket type in FIG. 4 (2). And, the supply air pressure: ps (kgf/mm$^2$).

The two-pocket type has 1.5 (=0.38/0.25) times larger load capacity as compared with the one-pocket type. And, the two-pocket type is such that the rigidity in the horizontal direction (rolling direction) is almost as high as in the vertical direction, and contact between the wiper roll receiving horizontal force and the static pressure bearing does not occur easily and this is convenient. In other words, by making the fluid bearing of two-pocket type having the fluid passage of the fluid bearing or two fluid jet nozzles, the rigidity in the direction of rolled material advance is superior and hence it is possible to support stably and it is possible to obtain the superior wiping performance. Also, it is possible to increase the pressing force and to improve the wiping performance, and it is possible to carry out wiping with high precision.

Incidentally, as shown in FIG. 4, in this example, an air chamber 23*b* is installed in the vicinity of the air nozzle of the air supply hole 23*a*. By installing the air chamber 23*b*, the stabler roll support becomes possible. And, by installing the air chamber 23*b* such that it extends in the circumferential direction of the roll as shown in FIG. 4, it is possible to stabilize more the roll support in the radial direction of the roll.

Also, in the three-pocket type with an additional pocket at the center of two-pockets or the type having more than four pockets, it is considered that there is no significant difference from the two-pocket type in both the vertical load capacity and horizontal rigidity. However, in the type with more than three pockets, the consumption of air used increases. In other words, adding the vertical load capacity and the horizontal rigidity together and considering the amount of consumption of air, the two-pocket type is desirable. Here, the two-pocket type is one in which the fluid passage supporting for its one roll has two in the roll circumferential direction, and it is desirable that they are installed at the entrance and the exit respectively, with the roll axis being the boarder. And, the jet nozzle (supply hole) of its fluid is desirably one which has two in the roll circumferential direction, and it is desirable to install two jet nozzle at the entrance and the exit respectively in the roll circumferential direction, with the roll axis center being the boarder. And, the jet direction of the fluid (the supply direction toward the roll) is desirably the direction toward the roll axis center, and the stabilization of the roll support can be designed. Incidentally, it is desirable to install at lease one each jet nozzle at the upstream side and the downstream side from the vertical plane including the roll axis.

And, from the equations (1) and (2), the residual oil film thickness h2 is represented by the equation (3) below.

$$h2=K\cdot(\nu\cdot V)/(C\cdot ps) \quad (3)$$

From this equation (3), in order to increase the wiping ability, it is understood that increasing the supply air pressure ps is effective. And, it is understood that it is effective to make the type of air bearing two-pocket type and increase the proportionality constant C. And, the wiper roll radius R is independent of the residual oil film thickness h2, but the follow-up to the plate crown is better when the roll radius R is small, therefore, it is desirable that the roll radius R is small.

Here, we roughly calculate the air pressure necessary for actual operation. At present, the wiping ability required of shadow mask rolled material is as follows. In the case of velocity V: 500 m/min, lubricant viscosity ν: 5 cSt (equivalent to velocity V: 250 m/min, lubricant viscosity ν: 10 CSt), the required residual oil film thickness h2 is 0.7 μm (corresponding to 630 mg/m$^2$). And, from the equation (3), if the required air pressure is calculated, it follows that $ps=K\cdot(\nu\cdot V)/(h2\cdot C)=6.1\times10^{-6}\times(5\times500)/(0.38\times0.7)=0.0053$ (kgf/mm$^2$)=5.73 (kgf/cm$^2$).

From this, it follows that it is desirable that the air pressure is close to 6 kgf/cm$^2$, and higher than 5 kgf/cm$^2$ at the lowest. (Being 5/5.73=0.87, the wiping ability of 87% of the above-mentioned operating value, a difference of this degree is usually permissible.)

Figure 10:
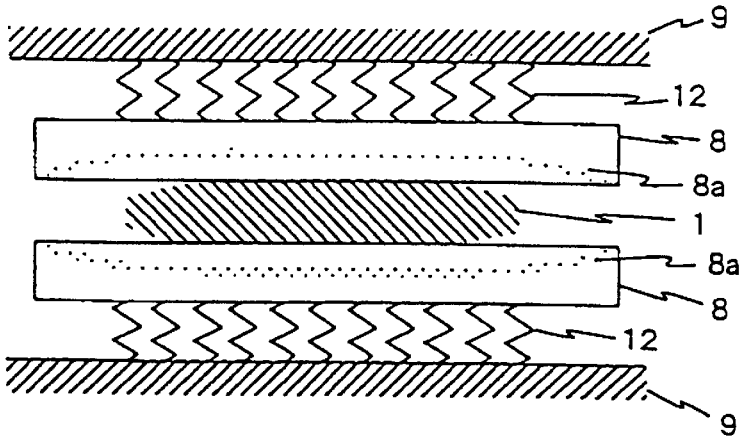
FIG. 10 is a diagram showing the state of wiping of a rolled material with a plate crown.

Then, we explain the adequate value of this roll radius. As one factor to determine this roll radius, the follow-up to the plate crown is considered. In this example, we paid our attention to this follow-up to the plate crown. As shown in FIG. 10, a quadratic thickness change occurs in the plate widthwise direction in the rolled material 1. Between the static pressure bearing (two-pocket) 9 and the finish wiper roll 8, the air spring 12 acts, and the static pressure (two-pocket) 9 supports the finish wiper roll 8, but the finish wiper roll deflects and the plate thickness of the end of the rolled material 1 decreases. That is, an edge drop (a sharp decrease in plate thickness at the body crown and the plate thickness edge) occurs.

A countermeasure to the edge drop phenomenon that occurs in this way is difficult, but it is desirable that the roll wiper can cope with the body crown which is a moderate plate thickness variation.

In the air bearing, the roll is floated by the air pressure, and as the roll pressing force increases, this floating amount decreases. That is, it has the spring property that the floating amount (deflection) changes in response to load. The spring effect of this air pressure is very important for the wiper.

Like the oil film bearing, if this spring constant is large, the roll cannot deflect, and hence the it cannot follow the plate crown. Conversely, if the spring constant is weak, the load capacity becomes too small, and it follows that the roll and the bearing contact before follow-up to the plate crown. The desirable floating amount in the air bearing is about 1/1000 of the roll diameter, for example, if the roll diameter is 30 mm, the desirable floating amount is 30 μm. A spring constant of the degree to follow-up the plate crown within this floating amount is desirable. By calculations and experiments, it was confirmed that the spring characteristics of the air bearing are within the desirable range.

FIG. 10 shows a diagram explaining the wiping state of the rolled material having the plate crown. We explain the follow-up properties to the plate crown of the above-mentioned roll wiper of air bearing type. As shown in FIG. 10, at the small plate width edge of plate thickness, the finish wiper roll 8 deflects like the curve 8*a* due to the air spring 12 of the static pressure bearing 9 which is the rear air bearing. And, the deflected finish wiper roll 8 comes into contact with the edge of the rolled material 1. However, the pressing force of this part becomes lower than the central part. Therefore, it follows that the residual oil film thickness h2 increases as much as the decrease of the load.

Figure 11:
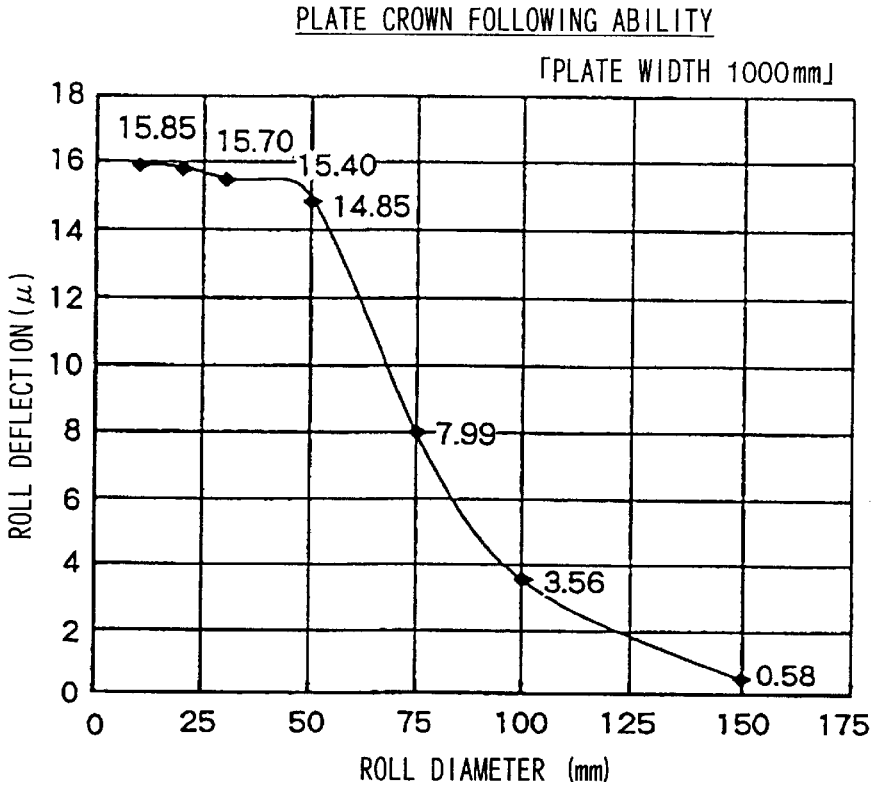
FIG. 11 is a result of calculations of follow-up (to the plate crown) of the roll wiper of air bearing type.

Next, FIG. 11 shows a relation diagram of the follow-up properties to the body crown of the plate at the roll wiper of air bearing type. Here, the relation between the roll diameter (mm) and the roll deflection ($\mu$m) is shown by calculating on the assumption that the roll deflects according to the same quadratic curve as the body crown. In this calculation, we calculate assuming that the plate width is 1000 mm and it is tolerated that the residual oil film thickness at the plate width edge increases by 20% from the central part. That is, we calculated to see how much plate crown it can respond assuming that the pressing force decreases by 20%. Since the calculated value is the deflection of one roll, the corresponding plate crown is twice the value of FIG. 11.

According to FIG. 11, up to the roll diameter of about 50 mm, the roll deflection is 15.85 $\mu$m~14.85 $\mu$m, it gradually decreases but it is almost the same. And, as the roll diameter exceeds 50 mm, the roll deflection suddenly decreases; when the roll diameter is about 150 mm, its deflection amount is very small or 0.58 $\mu$m. After all, it is understood that as the roll diameter exceeds 50 mm, the roll deflection decreases suddenly and the ability to respond to the plate crown decreases. Incidentally, even though the roll diameter is 60 mm, the ability to respond to the plate crown slightly decreases, it is within the usable range.

The above-mentioned study is one in which the load range of the air bearing is identical with the plate width; for example, in the case where the present invention is applied to the reverse rolling facility, the plate thickness in the initial pass is large and the plate crown is inevitably large. In this case, since it is not the final pass, a slight decrease in wiping ability is permissible; but it is possible to let it follow up the large plate crown by making the load range of the air bearing smaller than the plate width and thereby increasing the roll deflection.

Slipping of the wiper roll at the time of acceleration and deceleration is conceivable as another factor to determine the wiper roll diameter and we paid our attention to this factor in this example. As the roll slips or the roll velocity decreases below the velocity of the rolled material, the scratching of the rolled material by dust and foreign matter contained in lubricant occurs. And, scratches occur at the part where the roll comes into direct contact with the rolled material, with the result that the surface quality of the rolled material is impaired.

The friction coefficient f of the roll surface is proportional to the viscosity $\nu$ of lubricant, and it is represented by the equation (4) below, where $\nu$: lubricant viscosity (cSt). (This relationship has bee confirmed by computer simulation.)

$$f=7\cdot10^{-4}\cdot\nu \tag{4}$$

For instance, the friction coefficient is 0.007 at a viscosity of 10 cSt. By using this friction coefficient, the critical roll radius R1t that permits slip to occur at the time of acceleration or deceleration is represented by the equation (5) below.

$$R1t=\{120\cdot f.P.g/(\pi\cdot\gamma\cdot\alpha)\}0.5 \tag{5}$$

where g: acceleration of gravity (9.8 m/sec$^2$), $\gamma$: specific weight of roll (kgf/mm$^2$), $\alpha$: acceleration or deceleration (m/min/sec).

Figure 12:
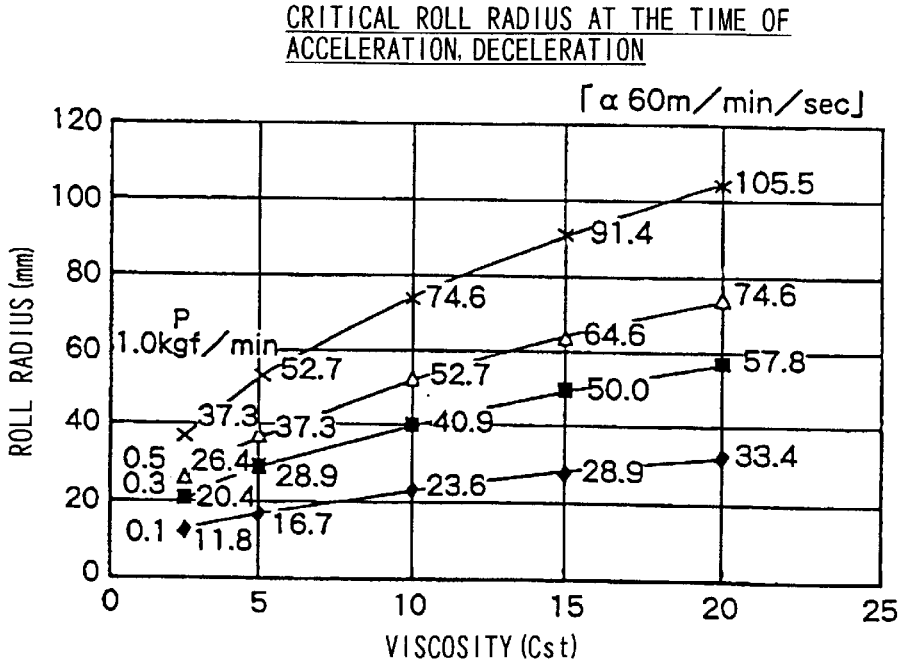
FIG. 12 is a result of calculations of the critical roll radius at which the roll wiper of air bearing type begins to slip at the time of acceleration and deceleration.

By using this equation (5), the critical roll diameter was calculated for acceleration or deceleration $\alpha$ 60 m/min/sec, pressing force P 0.1 kgf/mm (♦ mark), 0.3 kgf/mm (♦ mark), 0.5 kgf/mm (Δ mark), and 1.0 kgf/mm (x mark), which are ordinary operating conditions, and the results are shown in FIG. 12. FIG. 12 shows the critical roll radius at the time of acceleration and deceleration and shows the relation between viscosity (cSt) and the roll radius (mm). By this, for example, it is understood that it is necessary to keep the roll radius below 37.3 mm (74.6 mm in diameter) if the lubricant viscosity is 5~10 cSt and the pressing force is 0.5 kgf/mm (Δ mark).

If the two factors mentioned above are taken into account, it is understood that the roll diameter is as small as possible, below approximately 60 mm.

And, the limit at the smaller diameter side is considered that practically about $\phi$ 20 mm is a limit due to the increase in roll rotation in proportion to the smaller diameter and the increase in machining precision of the static pressure bearing. In other words, the limit of the smaller diameter side is considered to be about $\phi$ 20 mm in consideration of the increase in roll rotation and the increase in machining precision of the static pressure bearing.

As mentioned above, increasing the supply air pressure increases the pressing force, and as this pressing force increases, the wiping effect increases and it is convenient. In the following, we explain the factor that impedes this.

Figure 5:
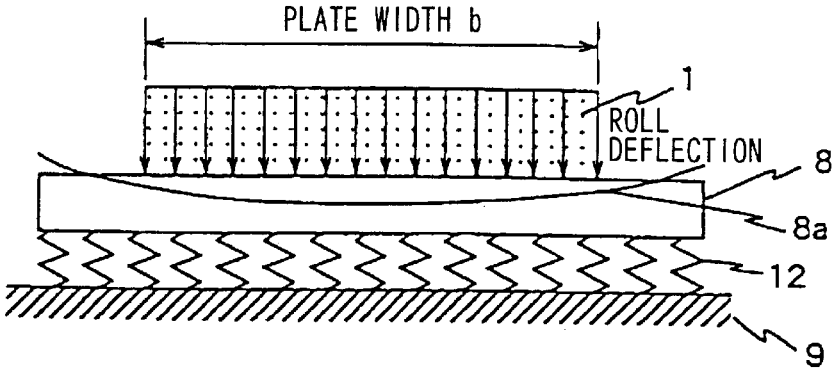
FIG. 5 is a diagram showing the state of the load of the roll wiper of air bearing type and the state of the roll deflection.
Figure 5:
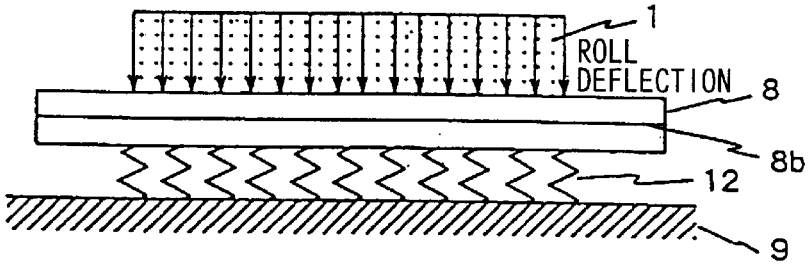

Here, the relation between the load applied to the wiper roll and the deflection of the wiper roll is shown in FIG. 5. Since the plate width b greatly varies depending on operating conditions, in normal operation, as FIG. 5(1) shows, the wiper roll outside the plate width receives bending force from the static pressure bearing 9 and greatly deflects as the curve 8*a*, by this, the rolled plate 1 is pressed down stronger than the center in the vicinity of its edge, and so-called edge elongation and shape defect occur.

This shape defect becomes larger as the roll diameter is smaller. In order to prevent this, as shown in FIG. 5(2), if the supply of air of the static pressure beating 9 is shut down in the region outside of the plate width b in the plate width direction, the air spring 12 in that region does not occur, as 8*b* in FIG. 5(2), bending force does not occur in the wiper roll. Therefore, the plate shape is not impaired. As the result, it is possible to make larger than pressing force. By adjusting the supply region of air in the plate width direction, it is possible to adjust the roll deflection.

In order to make it possible to correspond finely to the plate width, it is necessary to make the pitch c smaller which is the interval of air supply holes 23*a* in the roll axis direction (widthwise direction of the rolled material 1). However, in order to avoid vibrations (pneumatic hammer) by air pressure in the air bearing, it is necessary to make smaller the air pocket; therefore, this pitch c becomes as small as about 10 mm, and adjustment corresponding to the approximate plate width becomes possible, as mentioned above.

According to experiments, with a roll wiper diameter of $\phi$ 25 mm and an air supply pressure of 6.5 kgf/cm$^2$, excessive pressing down at the plate width edge does not occur, and good wiping effects were obtained.

As the above-mentioned result, it was confirmed that the roll wiper of air bearing type of the present invention has the wiping ability equal to or better than the conventional tubular wiper at both high-speed operation and low-speed operation.

Figure 2:
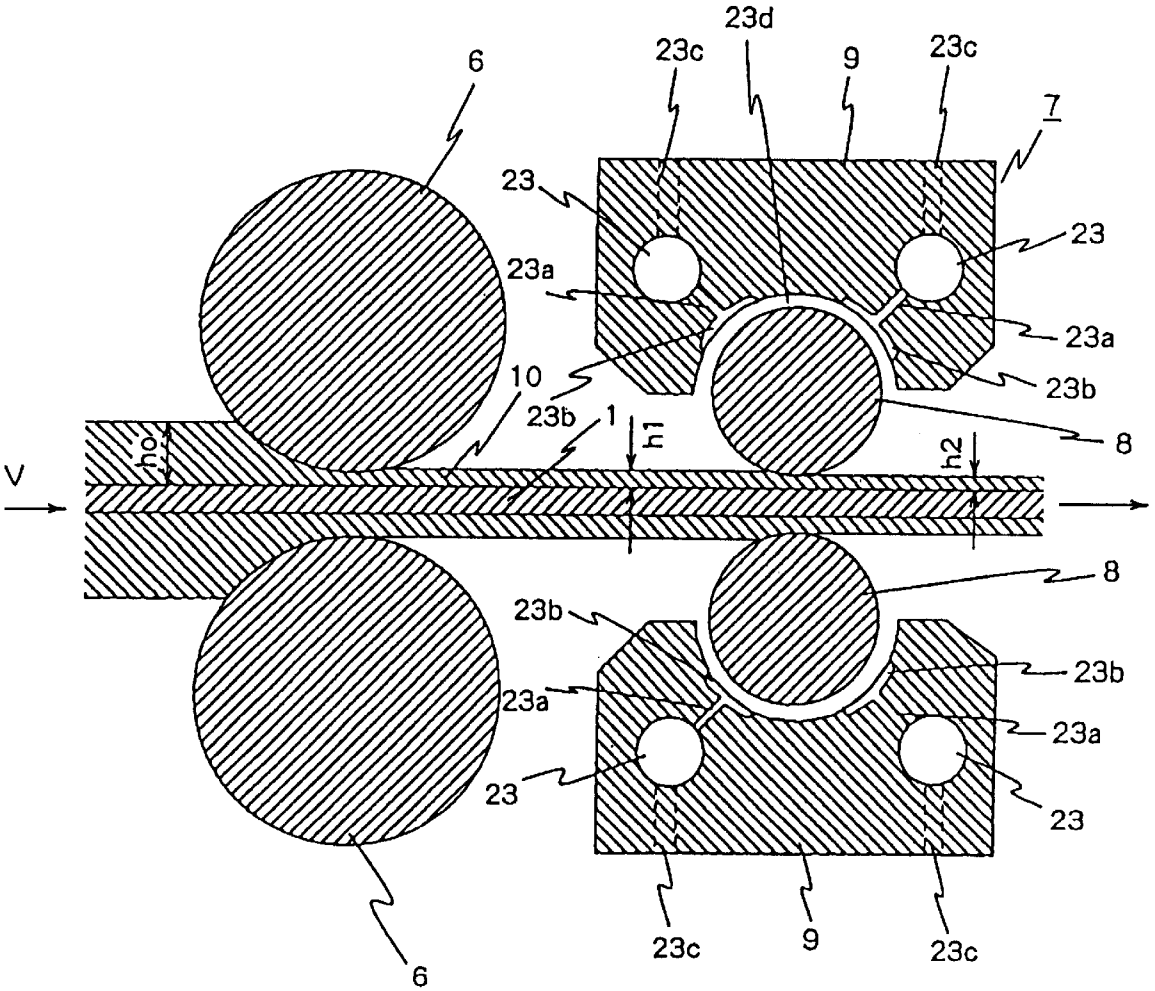
FIG. 2 is a wiping device according to the present invention in which rough wiping rolls are combined with roll wipers of air bearing type.

Next, regarding the wiping effect of the rough wiping roll, we explain with reference to FIG. 2. On the rolled material surface, a large amount of rolling lubricant sticks at the exit of the rolling mill, and this is roughly wiped by the rough wiping roll 6 and then finish wiping is accomplished by the finish wiper roll 8 of air bearing type.

Therefore, the rough wiping roll 6 is sufficient for the wiper structure of ordinary two-high pinch roll type.

The residual oil film thickness after rough wiping, that is, this becomes the oil film thickness h1 at the entrance of the roll wiper of air bearing type for finishing. For this oil film thickness h1, the desired pressing force P is added by the rough wiping roll 6.

Figure 8:
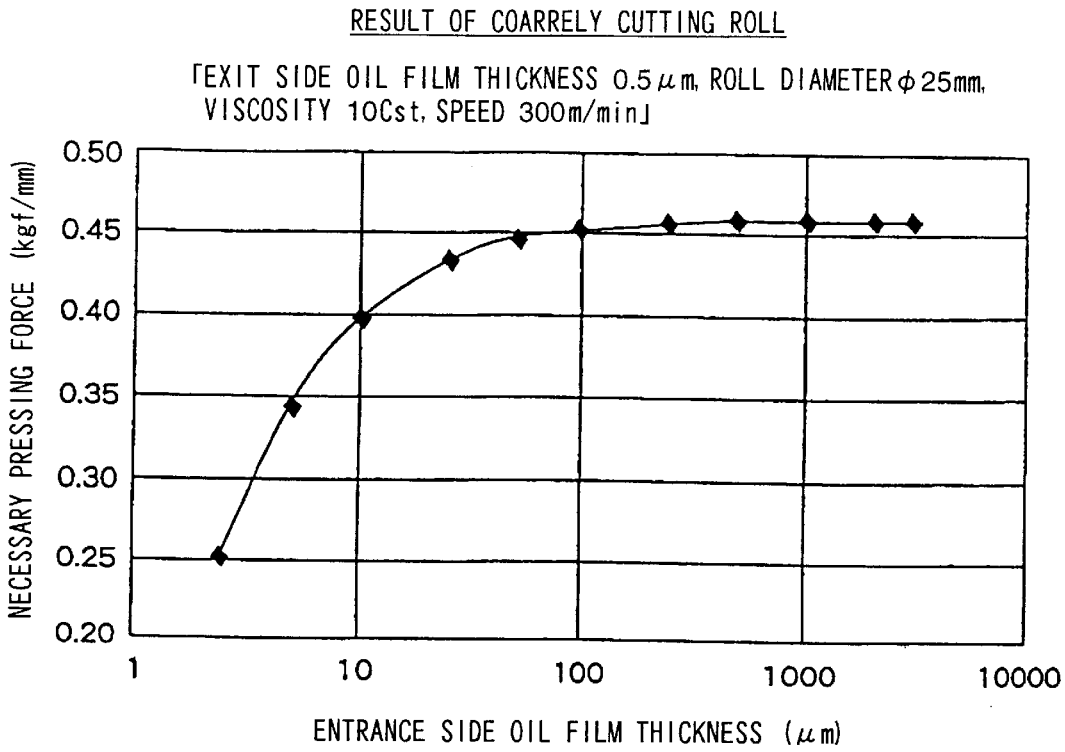
FIG. 8 is a diagram showing the effect of the rough wiping roll.

FIG. 8 shows the result of calculations of the pressing force P necessary to obtain the final residual oil film thickness h2. This FIG. 8 shows the relation between the oil film thickness ($\mu$m) at the entrance and the pressing force (kgf/mm) required, assuming that the oil film thickness at the exit is 0.5 $\mu$m, the wiper roll diameter is $\phi$ 25 mm, the viscosity is 10 cSt, and the rolled material advancing speed is 300 m/min.

It follows from this that the smaller the oil film thickness hi after rough wiping, the smaller the pressing force required. That is, the pressing force required to obtain the final oil film thickness 0.5 $\mu$m, with h1 being 1000 $\mu$m and 10 $\mu$m, may be about 15% ($\leftarrow$0.46/0.4=1.15) smaller. That is, since the residual oil film thickness h2 is inversely proportional to the pressing force P, the residual oil film thickness becomes about 15% less if the pressing force is the same.

If the oil film thickness after rough wiping is larger than 100 $\mu$m, there is almost no effect of its rough wiping; therefore, in the case where good wiping is not required, it is not always necessary to install the rough wiping roll. However, since rolling lubricant sticking at the exit of the rolling mill is supplied in large amounts to the strip wiper and is accumulated gradually, installing it is essential in the case where good wiping is required. And, the thinner the oil film at the entrance, the less the residual oil film (since the pressing force necessary to obtain the residual oil film greatly reduces, it is possible to greatly reduce the residual oil film if the wiper pressing force in the later stage is the same as that in the preceding state); therefore, if finish rolls are placed tandem, a good wiping effect can be obtained.

The air supply hole of the air bearing is throttled (orifice throttle) by the small diameter d, as shown in FIG. 4, in order to increase the rigidity as the air spring of the bearing, its diameter d is as small as $\phi$ 0.5–0.7 mm, and is clogged easily with dust and foreign matters. And the entrance of water into air becomes the sticking of water to the plate surface, and becomes the occurrence of rust and surface quality defects in the later process, and hence is not desirable. Therefore, it is desirable that air to be supplied to the air bearing should be dry air containing almost no moisture which has passed through a fine filter. Moreover, even with such consideration, it is impossible to avoid the occurrence of clogging in this supply hole in operation of long time.

So, the washing apparatus of the air supply hole (orifice part) on-line is necessary. This washing is insufficient in washing effect with a gas like air having a small mass, and washing with the same liquid as rolling lubricant having a high density is effective (if the oil used for this washing is the same as the rolling lubricant, there is no problem even though they are mixed together in the lower part of the rolling mill).

EXAMPLE

Figure 1:
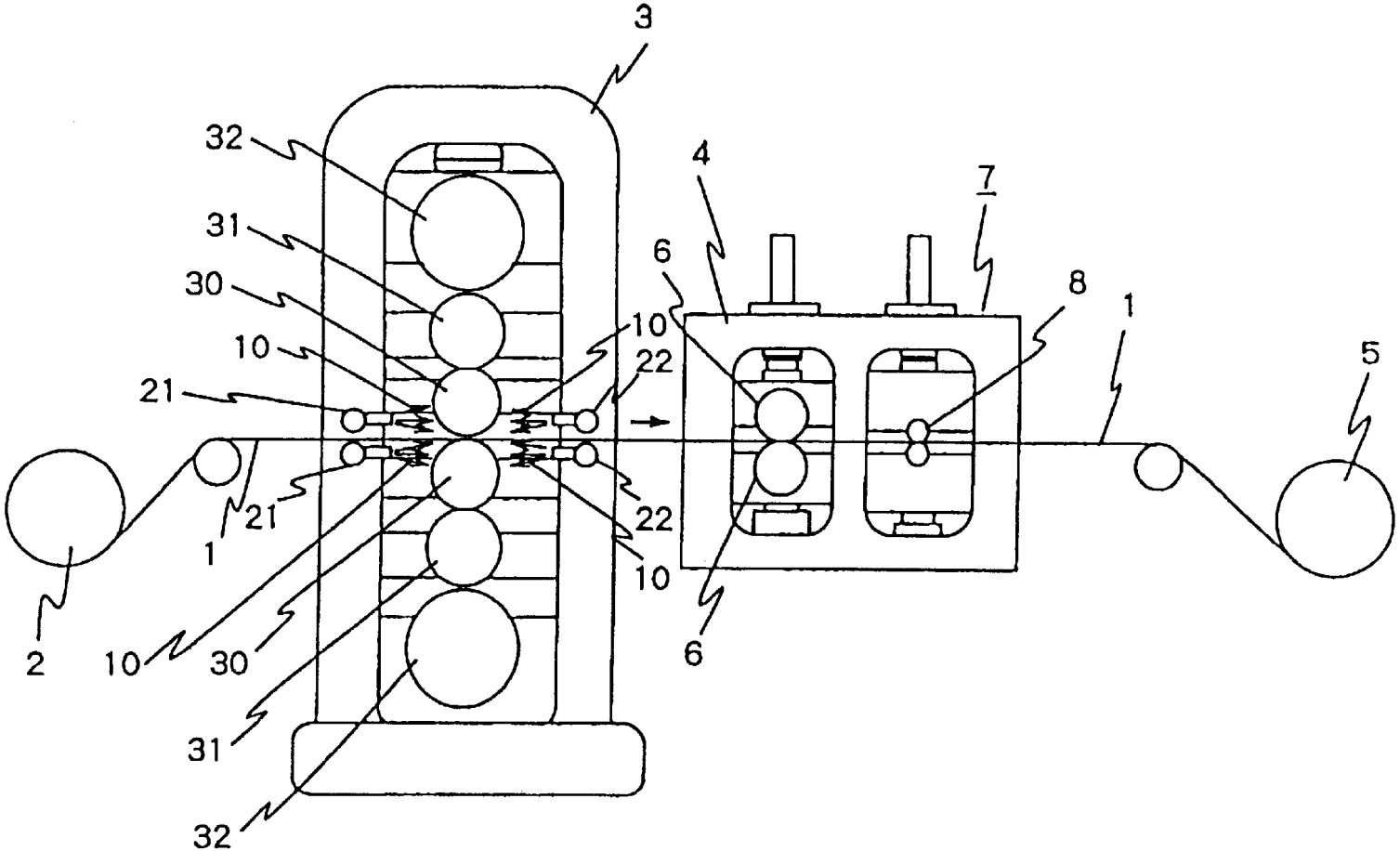
FIG. 1 is an example of the 6-high rolling mill provided with a roll wiper of air bearing type according to the present invention.

We explain below the example of the present invention with reference to the drawings. FIG. 1 shows, as one example of the present invention, a six-high cold rolling mill incorporated with wiper rolls of air bearing type.

The rolling facility of FIG. 1 is made up of an unwinder 2 to unwind the strip 1, a 6-high cold rolling mill 3 to roll the strip 1, a strip wiper 4 to remove liquid (such as lubricant) from the surface of the strip 1, and a winder 5 to wind up the rolled strip 1.

The 6-high cold rolling mill 3 is made up of a pair of upper and lower working rolls 30, a pair of upper and lower intermediate rolls 31 to support the working rolls 30, and a pair of upper and lower back-up rolls 32 to support the intermediate rolls 31. It is also provided with rolling lubricant supply means to supply rolling lubricant 10 to the gap between the working rolls 30 and the strip 1. In this example, these rolling lubricant supply means are installed at the entrance and exit of the 6-high cold rolling mill 3. In other words, the lubricant header 21 is installed at the entrance of the 6-high cold rolling mill 3 and the lubricant header 22 is installed t the exit of the 6-high cold rolling mill 3, and they are installed such that they can supply lubricant independently of each other.

The strip 1 which has been unwound from the unwinder 2 is rolled during its passage through the 6-high rolling mill 3. Here, the rolling lubricant 10 is supplied from the lubricant header 21 at the entrance of the 6-high cold rolling mill 3. Alternatively, the rolling lubricant 10 is supplied from both the lubricant header 21 at the entrance of the 6-high cold rolling mill 3 and the lubricant header 22 at the exit of the 6-high cold rolling mill 3. Subsequently, the rolled strip 1 reaches the strip wiper 4 installed at the exit of the 6-high cold rolling mill 3. Here, the rolling lubricant 10 sticking to the surface of the strip 1 is removed, and the strip 1 is wound up by the winder 5.

In this example, two sets of the strip wiper unit 4 are installed. The first strip wiper is installed at the entrance of the strip wiper unit 4 and the second strip wiper is installed at the exit of the strip wiper unit 4. The rolling lubricant 10 sticking to the surface of the strip 1 can be removed mostly by the first strip wiper at the entrance. And, the rolling lubricant 10 (reduced to some extent) sticking to the surface of the strip 1 can be removed by second strip wiper at the exit, and thus it is possible to reduce further the rolling lubricant 10 sticking to the surface of the strip 1.

As the first strip wiper installed at the entrance of the strip wiper unit 4 in this example, a pair of rough wiping rolls 6 are installed over and under the strip. And, as the first strip wiper installed at the exit of the strip wiper unit 4 in this example, a pair of finish wiper rolls 8 are installed over and under the strip.

FIG. 2 shows the construction of the strip wiper unit 4. The strip 1 advances at a velocity of v in the strip wiper unit 4. For the rolling lubricant 10 sticking to the surface of this strip 1, the strip is roughly wiped by pressing the strip to the paired upper and lower rough wiping rolls 6 which are the first strip wiper. In other words, before the strip 1 passes through the rough wiping roll 6, the thickness (oil film thickness) of one side of the rolling lubricant oil 10 sticking to the surface of the strip 1 is h0. And, much of the rolling lubricant 10 on the surface of the strip 1 is removed by the rough wiping roll 6, and the thickness (oil film thickness) of one side of the rolling lubricant oil 10 becomes h1. That is, it is possible to reduce the oil film thickness from h0 to h1.

Subsequently, the rolling lubricant 10 which sticks to the surface of the strip 1 and whose oil film thickness is h1 undergoes finish wiping by pressing the strip against the paired upper and lower finish wiper rolls which are the second strip wiper. In other words, before the strip 1 passes through the finish wiper roll 8, the thickness (oil film thickness) of one side of the rolling lubricant oil 10 sticking to the surface of the strip 1 is h1. And, the rolling lubricant 10 remaining on the surface of the strip 1 is efficiently removed by the finish wiper roll 8, and the thickness (oil film thickness) of one side of the rolling lubricant oil 10 becomes h2. That is, it is possible reduce the oil film thickness from h1 to h2. Incidentally, this finish wiper roll 8 is supported by the air static pressure bearing 9 of two-pocket type, so that it can reduce the residual oil film.

Since the wiping means of the rough wiping roll 6 and the wiping means of the finish wiper roll 8 are arranged sequentially from the entrance as mentioned above, it is possible to roughly remove oil film by the rough wiping roll 6 and adequately remove oil film by the finish wiper roll 8. Moreover, it is possible to obtain the superior wiping ability by removing oil film with good precision by supporting the finish wiper roll 8 by the fluid bearing.

Figure 3:
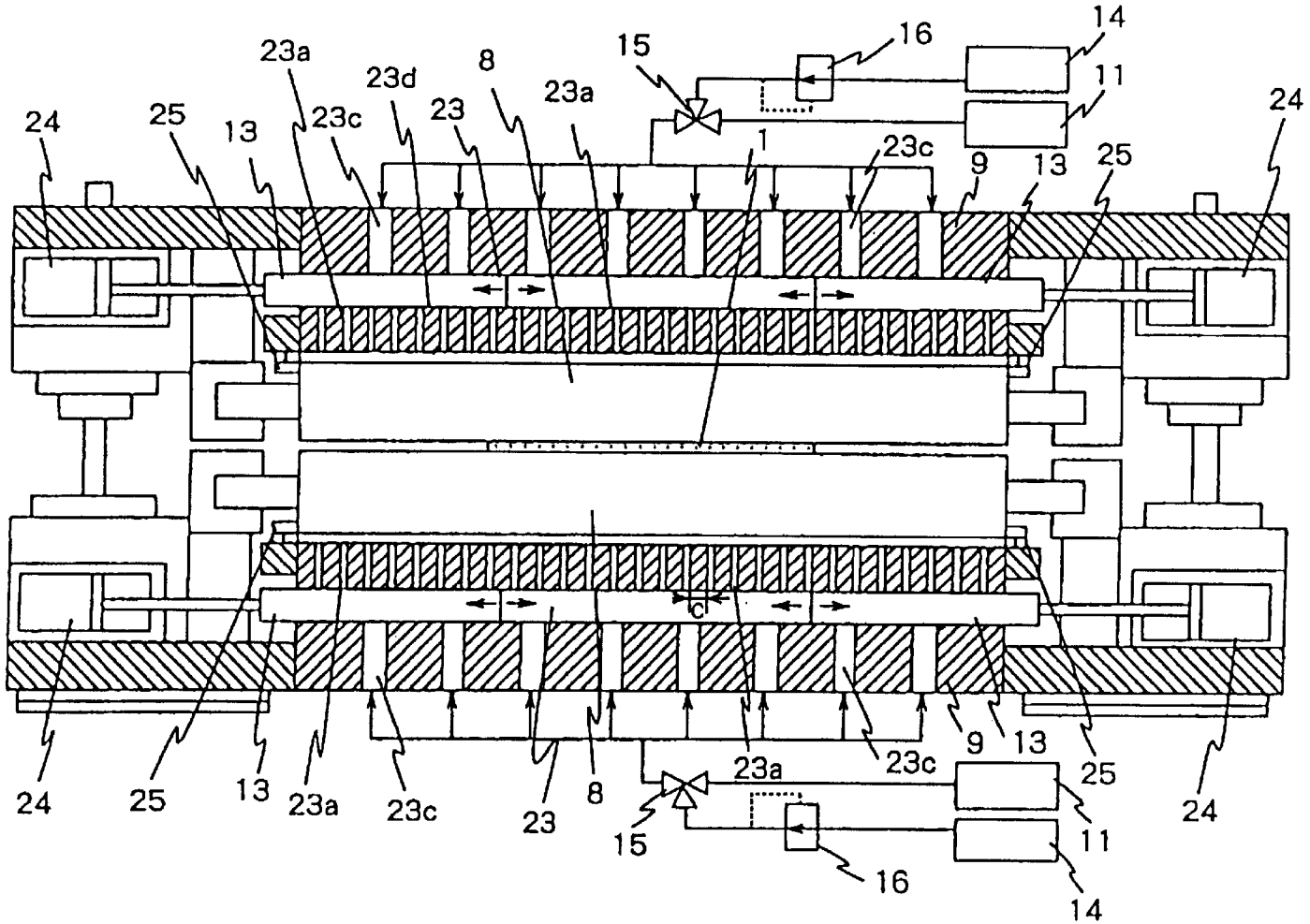
FIG. 3 is a sectional view (in the axial direction) of the finish wiper shown in FIG. 2.

FIG. 3 shows a sectional view in the axial direction of the finish wiper roll. The finish wiper rolls 8 are arranged as if they hold the strip 1 between them. The thrust blocks 25 are installed to prevent the finish wiper rolls 8 from dislocating in the axial direction. The static pressure bearings 9 having the gap 23*d* are arranged so as to support the finish wiper roll 8, and the first air supply holes 23*a* are formed in the roll side of the static pressure bearing 9. Air is supplied to this first air supply hole 23*a* and the wiper roll 8 is rotatably held by static pressure, with the gap 23*d* between them. This first air supply hole 23*a* is formed approximately in the roll radial direction, pointing toward the roll axial center, with two formed in the roll circumferential direction and a plurality formed in the roll axial direction.

In this example, air is supplied to the air distributing hole 23 once before air is supplied to the first air supply hole 23*a*. This air distributing hole 23 forms one air chamber penetrating in the roll axial direction. In other words, air is introduced into the gap 23*d* from the air distributing hole 23 through the air supply holes 23*a*.

And, the air distributing hole 23 is provided with the adjusting rod 13 on both sides in the roll axial direction. This adjusting rod 13 moves in the roll axial direction in the air distributing hole 23 and can adjust the air supply region in the roll axial direction (in the strip widthwise direction). As the mechanism to move this adjusting rod 13 in the roll axial direction, the hydraulic cylinders 24 are installed respectively in this example.

To the above-mentioned air distributing hole 23, air is supplied through the second air supply hole 23*c* from the outside. This second air supply hole 23*c* is outside the static pressure bearing and is installed approximately in the roll radial direction. And, the second air supply hole 23*c* is installed in a plural number in the roll axial direction. In this example, the size of the second air supply hole 23*c* is smaller than the size of the first air supply hole 23*a*, so as to facilitate air supply. And, the interval of arrangement of the second air supply holes 23*c* is larger than the interval of arrangement of the first air supply holes 23*a*, so as to facilitate air supply. It is desirable to make small the first air supply hole 23*a* at the roll side and to make small their arrangement intervals. By making small the first air supply hole 23*a* at the roll side, it is possible to stabilize the roll support, and by making small their arrangement intervals, it is possible to make fine adjustment for the air region.

As mentioned above, high-pressure air is supplied through a plurality of air supply holes 23*c* from the backside of the static pressure bearing 9. This air is supplied further to the finish wiper roll 8 from the intermediate air distributing hole 23 through orifices (diameter d) arranged with a small pitch c so as to generate the floating force. This floating force becomes the pressing force P of the wiper.

In this air distributing hole 23 is installed the adjusting rod 13 changeable in the widthwise direction in both sides of the axial direction, so that it is possible to adjust the supply width of air to the orifices. By this, it is possible to adjust in response to the plate width b the range to which the floating force of air of the static pressure bearing of the wiper roll applies.

Adjusting the range to which the floating force of the finish wiper roll 8 is applied corresponds to changing its width in which the finish wiper roll 8 is held by the air spring as shown in FIG. 5. FIG. 5(1) is one in which the above-mentioned adjustment in the widthwise direction is not performed and the finish wiper roll 8 is floated and supported for the entire width; the finish wiper roll 8 is not uniform in deflection in the widthwise direction, the pressing force at the plate width edge is large and the strip is excessively pressed accordingly, and edge elongation and shape defect occur. As the result, it follows that it is impossible to raise the wiper pressing force. On the other hand, as shown in FIG. 5(2), if the range of the air floating force is made to coincide approximately with the plate width b, the deflection of the finish wiper roll 8 becomes uniform in the axial direction, the overpressing of the plate width 10 end does not occur, it is possible to greatly increase the wiper pressing force P, as the result, the wiping effect greatly improves.

Also, FIG. 3 shows the cleaning unit to prevent the clogging of the orifice (the first air supply hole 23*a*) of the static pressure bearing 9. During operation in a certain period, air is supplied to the second supply hole 23*c* from the air supply unit 11 through the switching valve 15. And, after operation for a certain period, for example, the supply of air from the air supply unit 11 is suspended by the switching valve 15 and the cleaning oil is supplied from the cleaning oil supply unit 14. In this way, cleaning oil is introduced into the first air supply hole 23*a* through the second air supply hole 23*c* and the air distributing hole 23, and it is possible to remove dust and foreign matters clogging the orifice (the first air supply hole 23*a*). The reducing valve 16 is installed so that it is possible to adjust the supply pressure of the cleaning oil according to the load bearing capacity of the static pressure bearing of air. Incidentally, at resumption of operation, the supply of cleaning oil from the cleaning oil supply unit 14 is suspended by the switching valve 15 and air is supplied from the air supply unit 11; in this way, air is introduced into the first air supply hole 23*a* through the second air supply hole 23*c* and the air distributing hole 23, and the roll support becomes possible.

Figure 9:
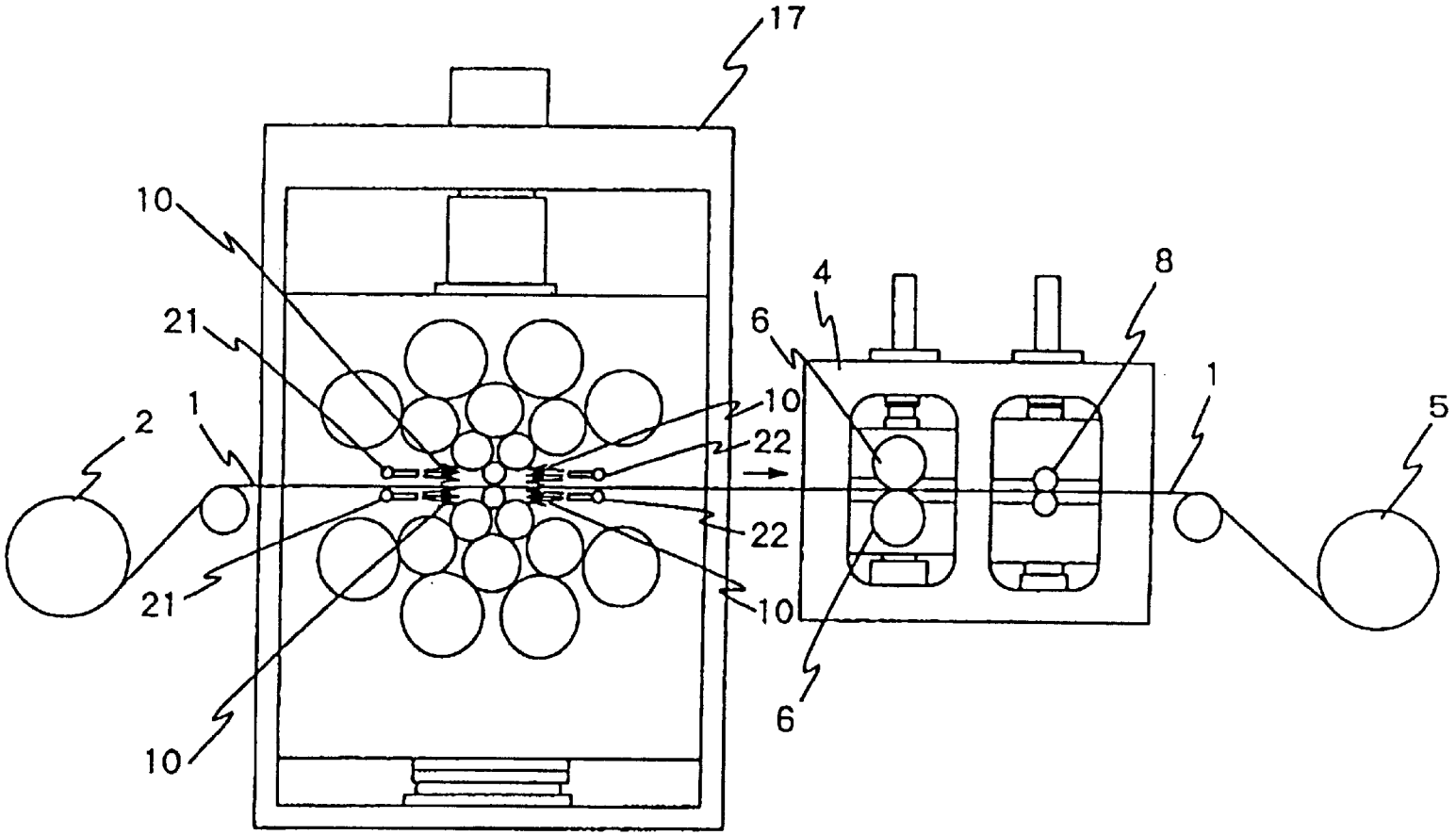
FIG. 9 is another example of the present invention demonstrating a 20-high Sendzimir mill cold rolling facility provided with the roll wiper of air bearing type.

FIG. 9 is another example of the present invention, in which the 6-high cold rolling mill of FIG. 1 has been replaced by a 20-high Sendzimir cold rolling mill. Likewise, it is apparent that the present invention can be applied to multiple cluster rolling mills other than 20-high ones.

FIG. 10 is a diagram explaining the state in which the finish wiper roll 8 is deflected by the plate crown present in the strip. For the wiper roll 8 to deflect following the plate crown, it is necessary that the bending rigidity of the wiper roll is small and it is understood that the wiper roll of small diameter is advantageous. However, the results of calculations of FIG. 11 are affected also by the spring constant of the air bearing, in the overall effect with the bending rigidity of the roll, there is no significant difference in ability to follow the plate crown in the case of roll diameter smaller than $\phi$ 50 mm.

Figure 7:
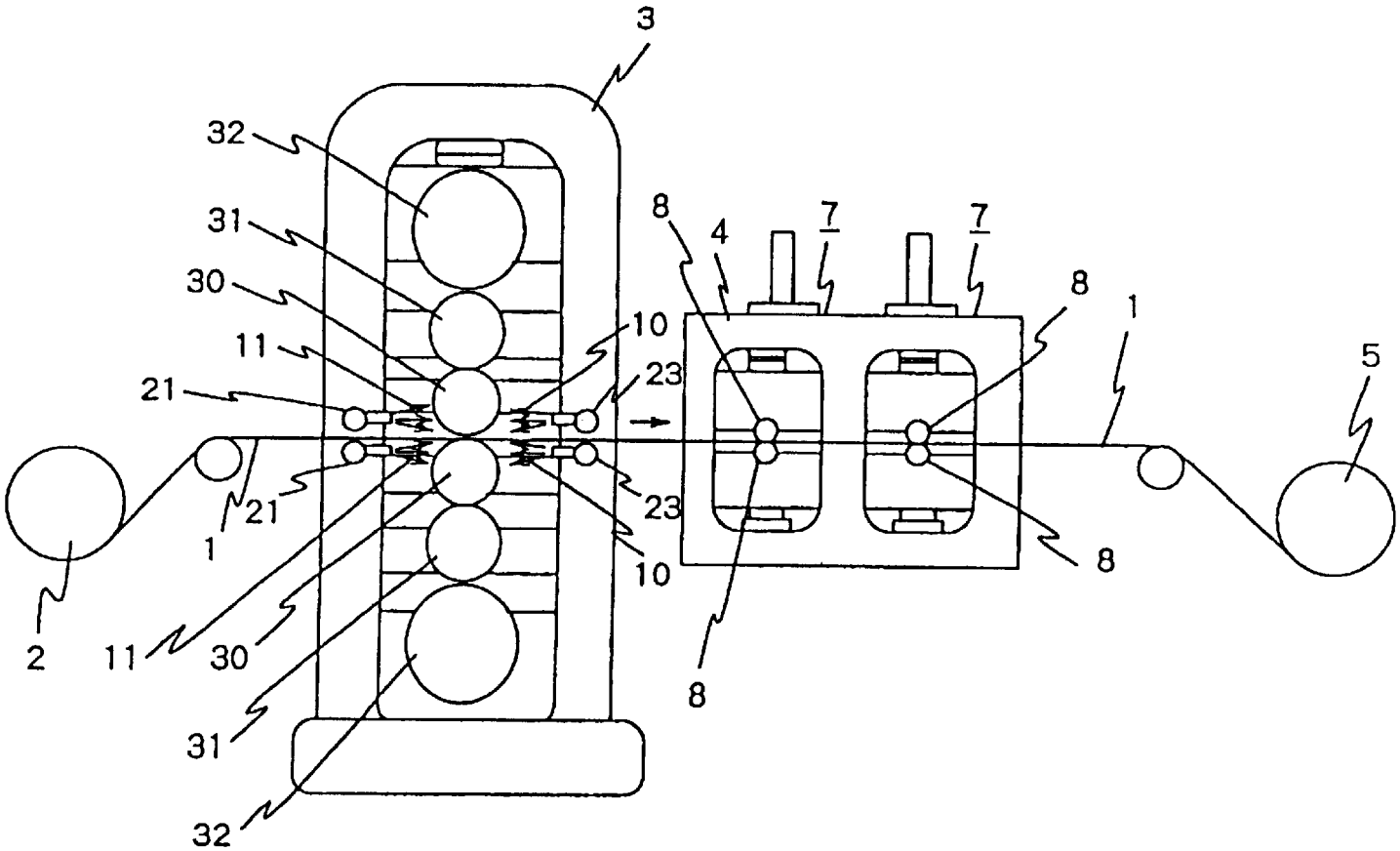
FIG. 7 is another embodiment of the present invention in which roll wipers of air bearing type are arranged tandem.

FIG. 7 is an example in which the roll wipers of air bearing type are arranged tandem in order to increase the wiping effect, by arranging like this, a further superior wiping effect is obtained.

The wiping unit of the present invention, at high-speed rolling exceeding 700 m/min which was incapable with the conventional roll wiper or tube wiper, it is possible to obtain the wiping ability equal to or better than the tube wiper at low speeds, and it contributes to the improvement of productivity of the cold rolling facility and the improvement of surface quality of the strip, and its effect is very large.

According to the present invention, the effect produced is that it is possible to provide the strip wiper unit superior in wiping ability to remove liquid from the strip surface, the method of wiping the strip, and the rolling facility and the rolling method.

What is claimed is:

1. A strip wiper device to remove liquid from a strip surface which comprises:

a wiper roll to remove liquid from the strip surface;

a fluid bearing to support the wiper roll, with the fluid bearing having at least two fluid passages in the circumferential direction of the roll; and an adjusting means to make adjustable the load bearing width in the strip width direction of said fluid bearing.

2. A strip wiper device as defined in claim 1, wherein the air supply pressure of said fluid bearing is greater than 5 kgf/cm$^2$.

3. A strip wiper device as defined in claim 1, which further comprises a supply unit to supply cleaning oil to the fluid passage of said bearing.

4. A strip wiper device as defined in claim 1, wherein respective ones of said wiper rolls supported by respective ones of said static pressure bearings are arranged in use respectively at an upper side and a lower side of a strip with said strip surface.

5. A strip wiper device according to claim 2, which further comprises a supply unit to supply cleaning oil to the fluid passage of said static pressure bearing.

6. A strip wiper device according to claim 2, wherein the wipe rolls supported by said static pressure bearing are arranged respectively at the upper side and lower side of the strip.

7. A strip wiper device according to claim 3, wherein the wipe rolls supported by said static pressure bearing are arranged respectively at the upper side and lower side of the strip.

8. A strip wiper device to remove liquid from a strip surface which comprises a first strip wiper and a second strip wiper which are arranged sequentially in the direction of strip advance, the second strip wiper being made up of:

a wiper roll;

a fluid bearing to support the wiper roll, with the fluid bearing having at least two fluid passages in the circumferential direction of the roll; and an adjusting means to make adjustable the load bearing width in the strip width direction of said fluid bearing.

9. A strip wiper device as defined in claim 8, wherein the diameter of the wiper roll of said second strip wiper is in the range of 20–60 mm.

10. A strip wiper device according to claim 8, wherein the diameter of the wiper roll of said second strip wiper is in the range of 20~60 mm.

11. A strip wiper device according to claim 8, wherein the air supply pressure of said fluid bearing is greater than 5 kgf/cm$^2$.

12. A strip wiper device according to claim 9, wherein the air supply pressure of said fluid bearing is greater than 5 kgf/cm$^2$.

13. A strip wiper device according to claim 8, which further comprises a supply unit to supply cleaning oil to the fluid passage of said static pressure bearing.

14. A strip wiper device according to claim 9, which further comprises a supply unit to supply cleaning oil to the fluid passage of said static pressure bearing.

15. A strip wiper device according to claim 8, wherein the wipe rolls supported by said static pressure bearing are arranged respectively at the upper side and lower side of the strip.

16. A strip wiper device according to claim 9, wherein the wipe rolls supported by said static pressure bearing are arranged respectively at the upper side and lower side of the strip.

17. A strip wiper device to remove liquid from a strip surface in cold rolling which comprises a first strip wiper for rough wiping and a second strip wiper for finishing which are arranged sequentially in the direction of strip advance, the second strip wiper being made up of:

a wiper roll;

a fluid bearing to support the wiper roll by pneumatic pressure, with the fluid bearing having at least two fluid passages for applying pneumatic pressure to the wiper roll at respective locations spaced in the circumferential direction of the roll, such that the wiper roll is supported by pneumatic pressure in two directions from the two fluid passages; and an adjusting means to make adjustable the load bearing width in the strip width direction of said fluid bearing.

18. A strip wiper device according to claim 17, wherein the diameter of the wiper roll of said second strip wiper is in the range of 20~60 mm.

19. A strip wiper device according to claim 17, wherein the air supply pressure of said fluid bearing is greater than 5 kgf/cm$^2$.

20. A strip wiper device according to claim 17, which further comprises a supply unit to supply cleaning oil to the fluid passage of said static pressure bearing.

21. A strip wiper device according to claim 17, wherein the wipe rolls supported by said static pressure bearing are arranged respectively at the upper side and lower side of the strip.

22. A strip wiper device to remove liquid from a strip surface which comprises a first strip wiper and a second strip wiper which are arranged sequentially in the direction of strip advance, the first and second strip wipers each being made up of a wiper roll and a fluid bearing to support the wiper roll, with the fluid bearing having at least two fluid passages in the circumferential direction of the roll, and an adjusting means to make adjustable the load bearing width in the strip width direction of said fluid bearing.

23. A strip wiper device to remove liquid from a strip surface which comprises a first strip wiper and a second strip wiper which are arranged sequentially in the direction of strip advance, the second strip wiper being made up of a wiper roll and a fluid bearing to support the wiper roll; and an adjusting means to make adjustable the load bearing width in the strip width direction of said fluid bearing.

24. A method of strip wiping to remove liquid from a strip surface which is characterized in that wiper rolls supported by fluid bearings are arranged above and below the strip surface, with the respective fluid bearings having at least two fluid passages in the circumferential direction of the roll, the fluid passages being supplied with a fluid so that the wiper roll is borne by the fluid and is pressed against the strip; and wherein the load bearing width in a strip width direction of said fluid bearing is adjusted according to rolling conditions.

25. A method of strip wiping to remove liquid from a strip surface of a strip which is characterized in that a wiper roll for rough wiping removes liquid from the strip surface and wiper rolls supported by fluid bearings are arranged above and below the strip at the downstream side, with the fluid bearings having at least two fluid passages in the circumferential direction of the roll, the fluid passages being supplied with a fluid so that the wiper roll is borne by the fluid and is pressed against the strip; and wherein the load bearing width in a strip width direction of said fluid bearing is adjusted according to rolling conditions.

26. A rolling facility which comprises a rolling mill and a strip wiper device to remove liquid from the strip surface at the exit of the rolling mill, said strip wiper device being made up of a wiper roll to remove liquid from the strip surface, a fluid bearing to support the wiper roll, with the fluid bearing having at least two fluid passages in the circumferential direction of the roll; and an adjusting means to make adjustable the load bearing width in the strip width direction of said fluid bearing.

27. A rolling facility as defined claim 26, wherein said rolling mill is one of a 6-high rolling mill provided with a lubricant supply unit to supply lubricant between rolls, and a multiple cluster rolling mill (including a 20-high Sendzimir rolling mill) provided with a lubricant supply unit.

28. A rolling method to be applied to a rolling facility made up of a rolling mill and a strip wiper device to remove liquid from a strip surface at the exit of the rolling mill, said method being characterized in that wiper rolls supported by fluid bearings are arranged over and under the strip, the fluid bearings having at least two fluid passages in a circumferential direction of the roll and the passages are supplied with a fluid so that the wiper roll is borne by the fluid, and the wiper roll is pressed against the strip so that liquid is removed from the strip surface while rolling is carried out; and wherein the load bearing width in a strip width direction of said fluid bearing is adjusted according to rolling conditions.

29. A rolling method to be applied to a rolling facility made up of a rolling mill and a strip wiper device to remove liquid from a strip surface at the exit of the rolling mill, said method being characterized in that a wiper roll for rough wiping removes most liquid from the strip surface, wiper rolls supported by fluid bearings are arranged over and under the strip, the fluid bearings having at least two fluid passages in a circumferential direction of the roll and the passages are supplied with a fluid so that the wiper roll is supported in two directions by pneumatic pressure, and the wiper roll is pressed against the strip so that liquid remaining unremoved by the wiper for rough wiping is removed from the strip surface while rolling is carried out; and wherein the load bearing width in a strip width direction of said fluid bearing is adjusted according to rolling conditions.

30. A strip wiper device which comprises:

a wiper roll to remove liquid from a strip surface;

a fluid bearing to support the wiper roll, said fluid bearing having at least two fluid jet nozzles toward the wiper roll in the circumferential direction of the roll; and an adjusting means to make adjustable the load bearing width in the strip width direction of said fluid bearing.

31. A strip wiper device which comprises:

a wiper roll to remove liquid from a strip surface;

a fluid bearing to support the wiper roll, said fluid bearing having at least one each fluid jet nozzle at the entrance and exit from the wiper roll axis center; and an adjusting means to make adjustable the load bearing width in the strip width direction of said fluid bearing.

32. A strip wiper device which comprises:

a wiper roll to remove liquid from a strip surface;

a fluid bearing to support the wiper roll, said fluid bearing having at least two fluid jet nozzles toward the wiper roll in the circumferential direction of the roll, said jet nozzles being arranged such that their jet direction is toward the wiper axis center; and an adjusting means to make adjustable the load bearing width in the strip width direction of said fluid bearing.

33. A method of making strip material comprising:

rolling a strip of material in a rolling mill to reduce the thickness of the strip while applying a lubricant to said strip, removing a substantial portion of said lubricant from said strip at a position downstream of the rolling mill in a strip wiper assembly, and coiling said strip on a coiler disposed downstream of the strip wiper assembly, said removing of said lubricant step including pressing respective wiper rolls against upper and lower sides of said strip with said wiper rolls supported by fluid bearing and wherein the pressure of the fluid bearings is adjusted across the strip width as a function of the rolling conditions in the rolling mill.

34. A method according to claim 33, wherein each of the fluid bearings include a plurality of circumferentially spaced fluid openings to the respective wiper rolls.

35. A method according to claim 33, wherein said pressure bearings are pneumatic bearings operable with air pressure greater than 5 $kfg/cm^2$.

36. A method according to claim 33, wherein the diameter of said wiper rolls is between 20 and 60 mms.

37. A method according to claim 33, further comprising periodic cleaning of fluid openings of said fluid bearings using pressurized flow of said lubricant.

38. A method according to claim 35, comprising periodic cleaning of fluid openings of said fluid bearings using pressurized flow of said lubricant.

* * * * *